US005718617A

United States Patent [19]

Priestley et al.

[11] Patent Number: 5,718,617

[45] Date of Patent: Feb. 17, 1998

[54] GRINDING FORCE MEASUREMENT SYSTEM FOR COMPUTER CONTROLLED GRINDING OPERATIONS

[75] Inventors: Terry W. Priestley; Stephen S. Buckingham, both of Springfield, Vt.

[73] Assignee: Bryant Grinder Corporation, Springfield, Vt.

[21] Appl. No.: 425,481

[22] Filed: Apr. 10, 1995

Related U.S. Application Data

[63] Continuation-in-part of Ser. No. 300,159, Sep. 2, 1994, abandoned.

[51] Int. Cl.[6] ..... B24B 49/10

[52] U.S. Cl. ..... 451/14; 451/21; 364/474.16

[58] Field of Search ..... 451/5, 14, 11, 451/21; 364/474.16

[56] References Cited

U.S. PATENT DOCUMENTS

| | | | |
|---|---|---|---|
| 3,601,930 | 8/1971 | Robillard | 51/165.8 |
| 4,079,624 | 3/1978 | Kurtz | 73/141 A |
| 4,193,227 | 3/1980 | Uhtenwoldt | 51/165.77 |
| 4,419,612 | 12/1983 | Reda et al. | 451/5 |
| 4,478,009 | 10/1984 | Rukavina et al. | 51/165.8 |
| 4,485,974 | 12/1984 | Lass | 241/30 |
| 4,549,372 | 10/1985 | Sexton et al. | 51/206 R |
| 4,570,389 | 2/1986 | Leitch et al. | 51/325 |
| 4,628,643 | 12/1986 | Gile et al. | 51/325 |
| 4,653,235 | 3/1987 | Farmer | 451/21 |
| 4,704,825 | 11/1987 | Moore | 51/290 |
| 4,831,785 | 5/1989 | Sigg | 51/165 R |
| 4,864,776 | 9/1989 | Morrison | 51/178 |
| 4,869,187 | 9/1989 | Little et al. | 112/262 |
| 4,873,792 | 10/1989 | Linke et al. | 51/165.8 |
| 4,897,967 | 2/1990 | Maruyama et al. | 51/165.87 |
| 5,025,594 | 6/1991 | Lambert, Jr. et al. | 51/165.93 |
| 5,042,206 | 8/1991 | Lambert, Jr. et al. | 51/165.77 |
| 5,044,125 | 9/1991 | Lambert, Jr. et al. | 51/165.93 |
| 5,070,655 | 12/1991 | Aggarwal | 51/165.71 |
| 5,168,758 | 12/1992 | Wolfer | 73/774 |
| 5,245,265 | 9/1993 | Clay | 318/568.11 |
| 5,245,793 | 9/1993 | Schmitz | 451/14 |
| 5,313,741 | 5/1994 | Toyama | 51/165.77 |
| 5,448,146 | 9/1995 | Erlbacher | 318/568.17 |

OTHER PUBLICATIONS

W.F. Bell, et al., "Practical Achievement and Monitoring of High Rate Internal Grinding, Part 1—Machine Instrumentation and Data Acquisition," *Society of Manufacturing Engineers (SME), Technical Paper MR88–611* (Oct. 1988).

B.D. Vaillette, "CBN–Adaptive Grinding," *Society of Manufacturing Engineers (SME), Technical Paper MR91–160,* pp. 4–1–4–25 Jun. 1991.

"The Ultraline UL2 High Speed Grinding Machine," *Bryant Grinder Corporation,* 257 Clinton Street, P.O. Box 2002, Springfield, VT 05156–2002 USA Aug. 1994 (Brochure).

*Primary Examiner*—Robert A. Rose

*Attorney, Agent, or Firm*—Hamilton, Brook, Smith & Reynolds, P.C.

[57] ABSTRACT

The present invention relates to a system for measuring a grinding force between a workpiece and a grinding wheel during the operation of a computer controlled grinding machine. A force transducer is mounted on a drive screw assembly between a moveable slide and a motor used to control movement of the slide. The force transducer generates a control signal that is conditioned and received by a digital signal processor, which instructs a machine controller to perform grinding operations in response to the measured force.

44 Claims, 5 Drawing Sheets

GRINDING FORCE MEASUREMENT SYSTEM FOR COMPUTER CONTROLLED GRINDING OPERATIONS

RELATED APPLICATIONS

This is a Continuation-in-Part of U.S. Ser. No. 08/300,159 filed on Sep. 2, 1994, now abandoned, the entire contents of which is incorporated herein by reference.

BACKGROUND OF THE INVENTION

Grinding of workparts with a superabrasive wheel involves several stages where different levels of the normal force can vary significantly including a rough grind stage at a high wheel infeed rate and a finish grind stage at a relatively low infeed rate with spark-out stages after each of the rough and finish grind stages. Grinding machines often include a workhead and wheel dresser. The workhead, wheelhead and dresser are of conventional construction where the workpart driven by the workhead spindle during grinding but at a lesser speed of revolution that of the grinding wheel which is rotated by the spindle of a wheelhead motor. The infeed rates are provided by movement of an X-axis slide under suitable servo loop control using a ball screw and drive motor controlled by the CNC control unit of the machine.

In maintaining wheel sharpness and controlling the grinding process, others have attempted to control the wheel feed rate by sensing deflection of the grinding wheel spindle in order to estimate grinding force. The normal force is the principal deflection causing force in the grinding process, particularly with internal grinding machines, and some prior machines have swiveled the wheelhead to re-align the wheel with the workpiece as the grinding wheel spindle is deflected.

Controlled force grinding has been utilized in order to ensure that a known deflection of the spindle could be maintained to control the resulting grinding process. Such controlled force grinding has its problems too, however, as eccentric rotation of the workpiece, or irregularities in the workpiece stock or hardness that causes run-out and prevents proper round-up of the workpiece. Some have located dynamometers adjacent the machine wheelhead to measure the normal force, but these have been expensive and are exposed to the grinding environment.

SUMMARY OF THE INVENTION

The present invention relates to the use of a force transducer on the coupling mechanism, or drive screw assembly, between the drive mechanism of a slide mechanism and the slide to measure the normal force between the grinding wheel and the workpiece in a grinding operation. The signal generated by the transducer can be used to control various aspects of the grinding process to improve the speed and efficiency of the machine. These can include controlling the infeed rate to provide constant force grinding during the rough grind stage in which the optimal grinding force is maintained between the grinding wheel and the workpiece, or to allow the removal of burnstock in the workpiece during the final phase of grinding. The invention is particularly suited to superabrasive grinding operations where the wheel sharpness varies during grinding. The present system is used to compensate for such variations. A more complete description of superabrasive grinding can be found in U.S. Pat. No. 4,653,235, the contents of which is incorporated herein by reference.

In a preferred embodiment the transducer is a load washer mounted in the ball screw housing to measure forces exerted during a grinding operation along the longitudinal axis of the ball screw and the slide to which it is coupled. A control circuit receives signals from the load transducer and manages certain processes in the grinding operation to provide the desired grinding force. In a preferred embodiment the control circuit includes a charge amplifier, a signal conditioning circuit, a digital signal processor, and a motion controller.

In preferred embodiments, a piezoelectric load transducer can be mounted on either or both slides of a two slide grinding machine. The two slide machine can be a compound slide mechanism or two independent slides mounted on a common bed.

In a different embodiment a load washer force transducer can be mounted relative to the ball screw nut as opposed the ball screw housing. This provides for many of same advantages but requires more extensive alteration of the slide carriage whereas mounting the transducer in the ball screw housing provides for easy retrofitting of the unit onto existing machines. When the transducer is mounted between the ball nut and the slide, this provides a more rigid configuration that is not sensitive to the tolerances of the support bearing.

Another preferred embodiment utilizes one or more accelerometers mounted on the grinding machine to measure vibrations on the machine that are used to compensate the load transducer signal and thereby produce more accurate control of the grinding force.

The present invention yields a number of advantages. First, it enables detection of the normal load between the grinding head and the workpiece. This detection apparatus has low cost and provides improved machine compactness particularly with respect to the embodiment having the transducer placed entirely within the ball screw housing. Further, as pointed out above, this embodiment requires few modifications of the ball screw housing and ball screw, it is easy to retrofit into existing machines. Further, the load detection assembly is entirely contained within the ball screw housing therefore protecting it from the grinding environments.

BRIEF DESCRIPTION OF THE DRAWINGS

In the accompanying drawings, like reference numerals refer to the same parts throughout the different views. The drawings are not necessarily to scale, emphasis instead being placed upon illustrating the principles of the invention. Of the drawings.

DETAILED DESCRIPTION OF THE INVENTION

Figure 1:
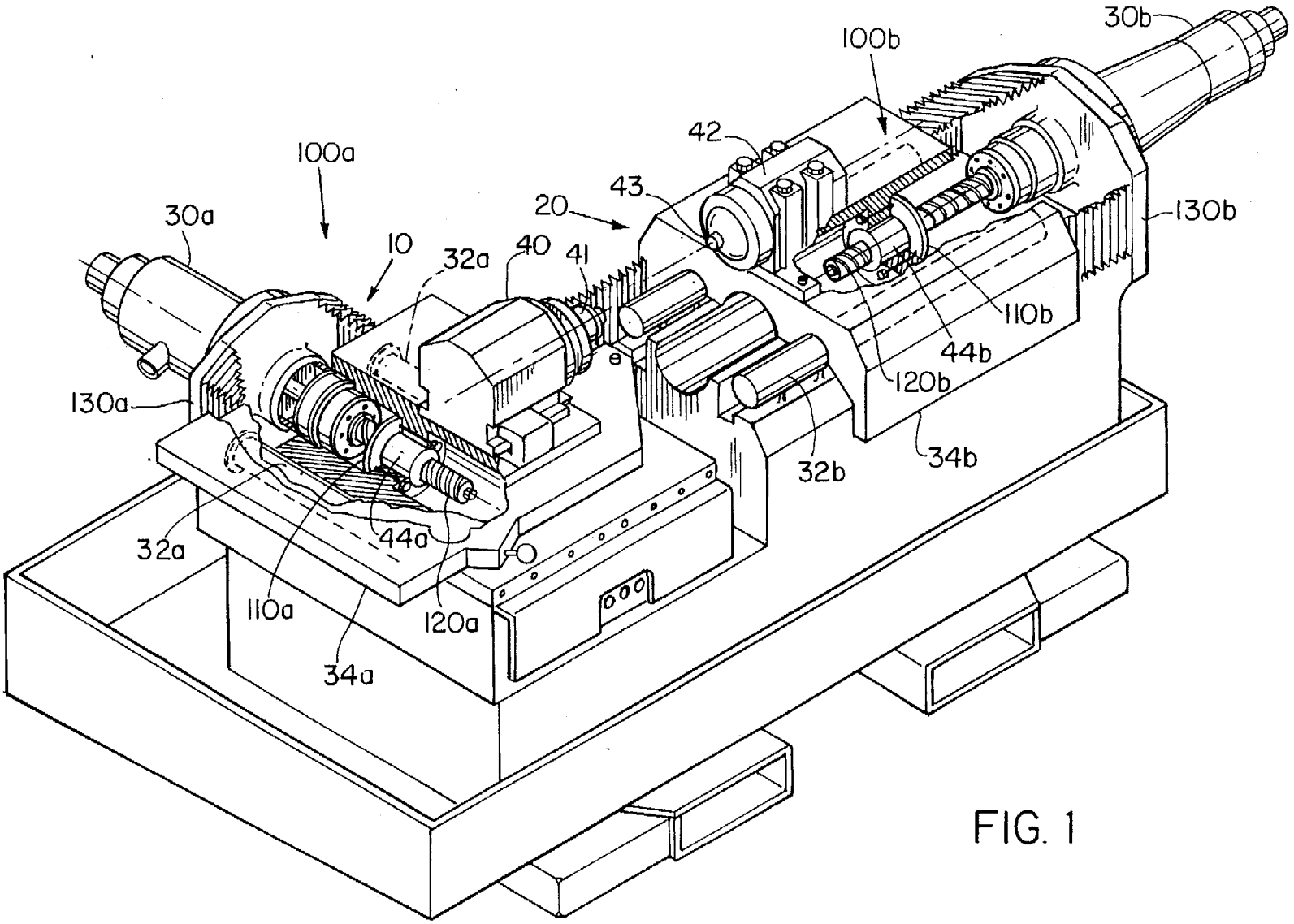
FIG. 1 is a perspective view of a grinding machine of the present invention.

Turning now to the figures, a grinding machine constructed according to the principles of the present invention is illustrated in FIG. 1. Generally, a wheelhead 42 and a workhead 40 are mounted to orthogonally oriented slide mechanisms 20, 10 on a bed 1. In the specific embodiment illustrated, the workhead 40 is mounted to the feed slide mechanism 10 and the wheelhead 42 is mounted to the Z-slide mechanism 20. It should be noted that this configuration could be easily reversed by mounting the wheelhead on the feed-slide. Still further, one of the heads could be stationary, such as the wheelhead, and then the workhead placed on a X-Z compound slide. The present invention is applicable to any one of these configurations. The particular configuration is generally dictated by the particular type of grinding performed and workpiece dimensions.

The workhead 40 comprises a chucking mechanism 41 for holding a workpiece (not shown) which it both supports and drives. The wheelhead 42 similarly supports and drives a grinding wheel, not shown, typically mounted to the end of the wheelhead spindle 43.

The feed slide mechanism 10 comprises a feed slide 34*a* which slides horizontally on two slide bars 32*a*. These slide bars 32*a* are rigidly mounted to a bed 1. In a similar vein, the Z-slide mechanism comprises a Z-slide 34*b* which slides on corresponding hydrostatic slide bearings which ride on the bars 32*b*. The relative longitudinal movement of the slides 34*a*, 34*b* on their corresponding slide bars 32*a*, 32*b* is each controlled by coupling mechanisms or drive screw assemblies 100*a*, 100*b* which are in turn driven by drive mechanisms such as servo motors 30*a*, 30*b*. For example, the coupling mechanism 100*a* comprises a ball screw 120*a* which is driven by the feed servo motor 30*a*. A ball nut 110*a* has internal threads which effectively mate with the ball screw 120*a* through multiple circuits of preloaded balls while being rigidly bolted to the feed slide 34*a* by bolts 44*a*. As a result, the rotation of the ball screw 120*a* by the feed servo motor 30*a* causes the longitudinal movement of the feed slide 34*a*.

In more detail, a ball screw housing 130*a* of the coupling mechanism 100*a* is mounted by bolts (not shown) to a side of the bed 1. The feed servo motor 30*a* is then bolted to the back side of this housing 130*a*. The slide bars 32*a* sit in the front of the housing 130*a* mounted to the bed 1. This ball screw housing 130*a* supports the ball screw 120*a* as a cantilever above the bed and maintains a distal end of the ball screw in engagement with a drive shaft of the feed servo motor 30*a*.

The Z-slide mechanism 20 is constructed much the same as the feed slide mechanism 10. Here, rotation of ball screw 120*b* moves the slide 34*b* via ball nut 110*b*. The ball screw 120*b* is supported by ball screw housing 130*b* which, in turn, is bolted to the bed 1. The ball screw 120*b* of the drive screw assembly is then driven by z-servo motor 30*b* mounted on the rear side housing 130*b*.

Figure 2:
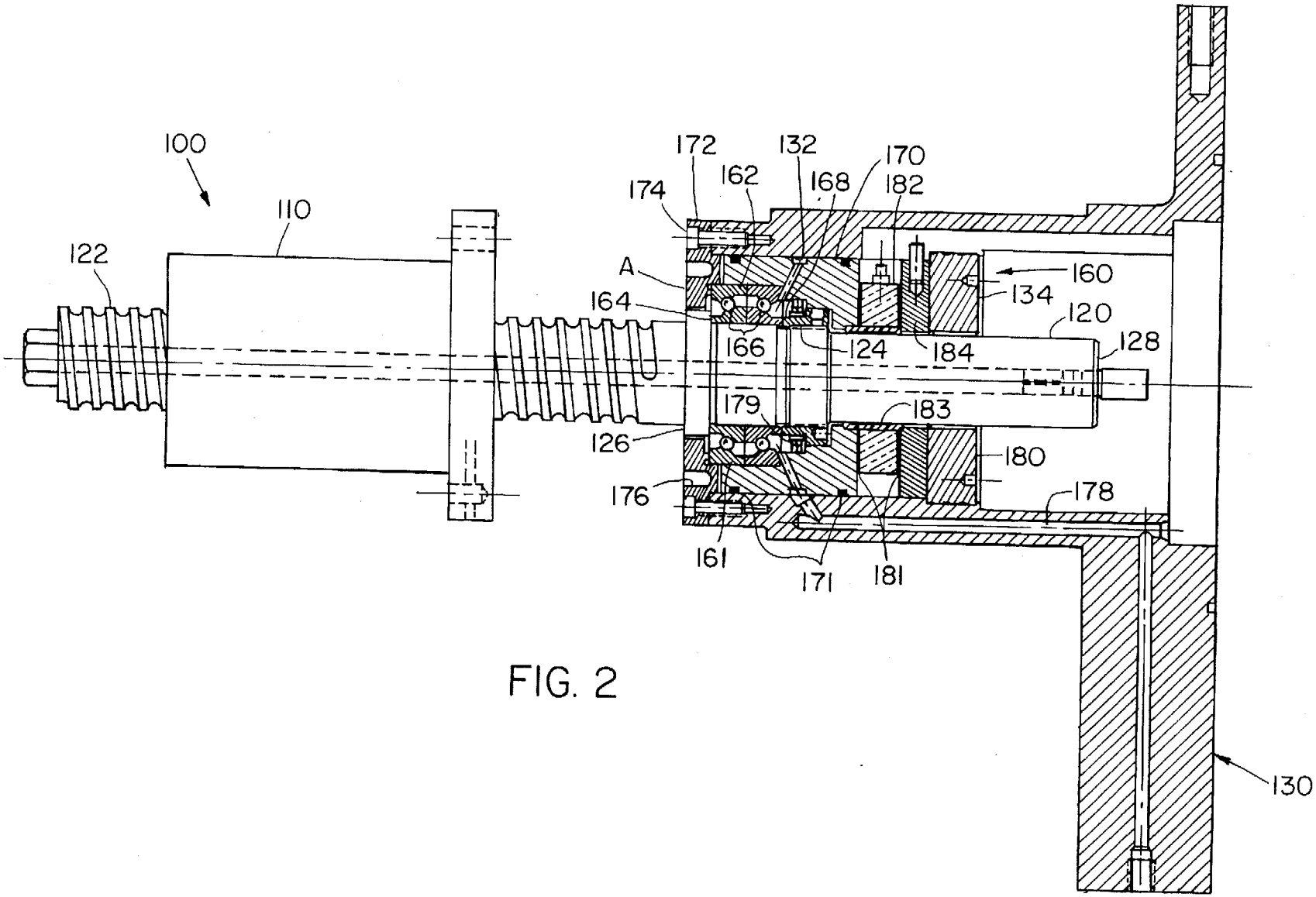
FIG. 2 is a cross-sectional view of a ball screw housing of the present invention.

Referring to FIG. 2, the coupling mechanism 100 illustrated is generic to both the feed slide mechanism 10 and the z-slide mechanism 20. The coupling mechanism 100 generally comprises the ball screw housing 130 that supports the ball screw 120. This ball screw is driven by servo motor (30*a*, 30*b*) engaging the distal end 128. The ball nut 110 then rides on the threaded portion 122 of the ball screw 120 so that in response to the rotation of the ball screw 120 in the ball screw housing 130, the ball nut 110 is moved axially along threaded portion 122 of the ball screw 120.

The force exerted by the grinding wheel against the workpiece is detected in the coupling mechanism 100 at a load washer assembly 160 in the mechanical junction between the ball screw 120 and the ball screw housing 130. Generally, the load washer assembly 160 comprises: ball screw support bearings 161, a bearing nut 168, a bearing sleeve 170, a load washer nut 180, a load washer 182 which functions as a force transducer, and a thrust washer 184.

Specifically, the ball screw 120 is journaled to the ball screw housing 130 by the ball screw support bearings 161. These are precision ball screw support bearings commercially available from the Torrington Company of Torrington Conn., for example. A duplexed pair or quadriplexed set, each comprising an outer race 162, an inner race 164 and a plurality of balls 166, are preloaded against each other to provide zero backlash, or end play, and high axial stiffness.

The inner race 164 forms an essentially mechanical extension of the ball screw 120 and is consequently axially confined between an annular shoulder 126 integral with the ball screw 120 at the proximal end and confined at the distal end by bearing nut 168. The bearing nut 168 has threads on its inner circumference which mate with threads 124 formed on the ball screw 120. A seal 179 is provided to confine the grease between the inner and outer bearing races 164, 162.

The outer bearing race 162 is confined between the bearing sleeve 170 and an end cap 172. An outer circumference of the end cap 172 is rigidly connected to the ball screw housing 130 via a circumferential array of bolts 174 that extend through the end cap 172 and seat in the proximal end of the ball screw housing 130. The end cap 172 has an annular relief or cutout portion 176 formed in it which is concentric with the ball screw 120. As a result, the end cap 172 behaves as a semi-rigid flexing diaphragm which allows a certain degree of axial resiliency and movement in the outer bearing race 162 relative to the ball screw housing 130.

The distal end of the outer bearing race 162 engages the bearing sleeve 170 which freely slides in the axial direction in the ball screw housing 130. A clearance of a few thousandths of an inch exists between the outer circumference of the bearing sleeve 170 and an inner wall 132 of the ball screw housing. Two O-rings 171 bridge this gap, and the natural resiliency of the O-rings 171 centers the bearing sleeve 170 within the ball screw housing 130.

Moving farther to the right in FIG. 2, the load washer nut 180 is threaded along its outer surface to rigidly connect with an inner threaded surface 134 of the ball screw housing 130. Between the load washer nut 180 and the bearing sleeve 170 lies the load washer 182 and the thrust washer 184. Basically, the load washer nut 180 serves as a mechanical ground or point of substantial rigidity. Minute axial movements of the bearing sleeve 170 and the outer race are thus permitted by the flexing diaphragm action of the end cap 172. These changes in the axial load of the load washer assembly 160, which are indicative of forces acting on the ball screw 120, are detected by the load washer 182, which is electrically isolated by insulating washers 181 and centering sleeve 183. Of note is the fact that although the bearing sleeve 170 moves axially to some degree, the O-rings do not slide across the inner wall 132 but deform slightly to permit for the axial movements.

The load washer 182, as shown, is manufactured by Kistler Industries such as that company's 9000 or 9100 series, although load washers from other manufacturers could be used. These piezoelectric force transducers offer high rigidity, which provides an inherently high natural frequency and associated rise time, and thus permit the measurement of extremely fast events. Generally, piezoelectric force transducers are well suited for measuring dynamic events but cannot perform truly static measurements. Although the electric charge delivered under a static load can be registered, it cannot be stored for an indefinite period of time. As a result, these piezoelectric transducers are preferably stacked quartz discs or plates having ultra-high insulating resistances that allow quasistatic measurements.

Since the load washer 182 can only measure compressive loads, the load washer nut 180 is tightened to preload the load washer assembly 160 prior to operation. Specifically, the load washer nut 180 is tightened until 0.0003 to 0.0005 inches of deflection are detected on the end cap 172 as measured at point A. This degree of preloading is selected such that it will exceed the forces exerted by the ball screw mechanism 100 on the grinding head ensuring that the load washer 182 is always under a compressive load. This degree of preload is also selected to preload the ball screw support bearings against one another by bringing the outer races 162 into face contact with one another according to the standard practice for angular contact ball bearings.

Figure 3:
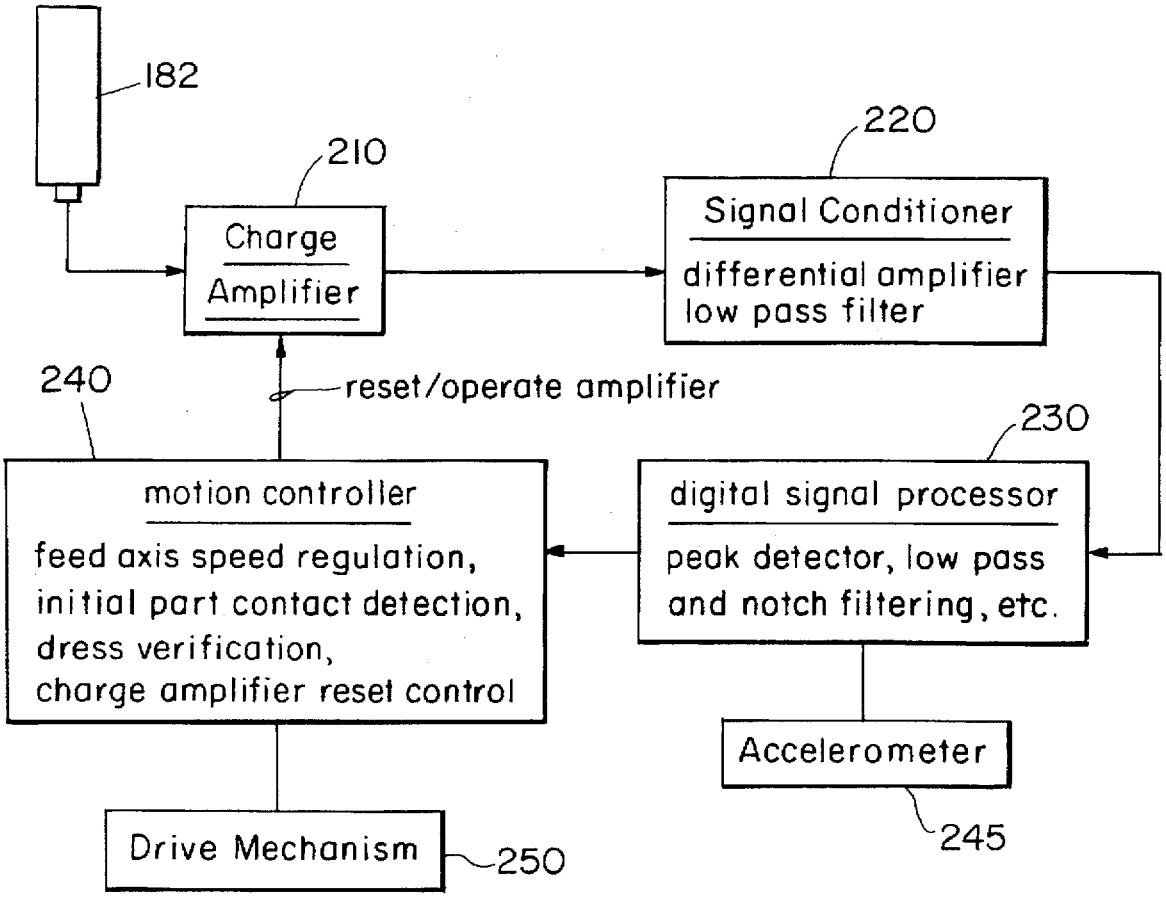
FIG. 3 is a block diagram of a control circuit of the present invention.

Referring to FIG. 3, a control circuit manages the grinding operation in response to the electrical signals from the load washer 182. Prior to the grinding operation, when the slide assembly is under a no-load condition, any residual charge on the load washer 182 is dissipated by a charge amplifier 210 which shorts out the lines from the load washer 182 in response to a reset signal. Charge thereafter generated by the load washer 182 represents a change in the forces on the coupling mechanism 100 and is amplified by the charge amplifier 210. A buffered voltage output of the amplifier 210 is signal conditioned by a differential amplifier/low pass filter 220. A digital signal processor 230 measures the output from the signal conditioner so that the signal produced by the load washer 182 is converted into the net force exerted by the grinding head against the workpiece. Since the load washer 182 is only capable of measuring quasistatic events, a digital signal processor 230 estimates the charge dissipation in the load washer 182 and charge amplifier 210 and the changes in the charge from the load washer to determine the net force exerted by the grinding head over time. The net grinding force detected by the digital signal processor 230 is then provided to a motion controller 240 which regulates feed axis speed and direction, detects the initial part contact, and verifies the dress of the grinding wheel to generally control the grinding process. Such a controller for multiple slides are disclosed in U.S. Pat. No. 4,419,612 which is incorporated herein by reference.

The information concerning the force exerted by the slide mechanism which is generated by the digital signal processor 230 is used for a number of purposes by the motion controller 240. Grinding cycle time of the grinder can be decreased during the period of initial contact between the workpiece and the grinding wheel. That is, the feed rate can be dynamically adjusted during this portion of the grinding process in response to the normal force signal to minimize the time needed to reach the desired level of force between the grinding wheel and the workpiece.

The force information is also utilized to decrease the spark-out interval. In the typical grinding operation, the slide mechanism is set to a predetermined position at the end of the roughing or finishing stage, the spark-out interval is then determined by machine stiffness and work removal rates. Variable sparkout intervals have been demonstrated as disclosed in U.S. Pat. No. 4,653,235 which in incorporated herein by this reference.

In the present invention, the force data is applied to dynamically control the feed position and feed rate to track a reference force versus time profile. Conventional control techniques can be used to accomplish this end by varying grind feedrate and position to reduce the error between desired and actual grind force. If a desired force profile is known which will optimize the grind process for a given process characteristic, then the grind feedrate and position can be modified to improve the process performance with regard to this particular characteristic. Grind cycle time, for example, is an important factor in determining a machine's production rate and if this time can be reduced then the grind cycle may be optimized for a higher production rate. Conventional control methods include proportional error control where the corrective control action, commanded feed velocity, is varied in proportion to the error between reference, or command, and measured force. Also, integral error control can be used where the corrective control action is proportional to the time integral of the error between commanded and measured force. Finally, feedforward compensation can be used where the estimated correction to a given force disturbance is summed with the reference force profile in such a way as to reduce the effect of the disturbance.

One specific application which follows this methodology optimizes grind cycle time by reducing the rough spark out interval from that of a conventional rough sparkout step where the feed slide is halted and the force decay rate is established by the machine stiffness and work removal rate. In this case, the desired force profile includes a region where the grind force drops instantaneously from the rough force level to the finish force level. This rapid reduction is grind force is preferably less than 0.5 seconds, and is typically in the range of 0.2–0.3 seconds. Conventional proportional plus integral error control techniques using infeed rate as the control action and applied according to this method result in the grinding wheel being withdrawn from the work part which reduces machine deflection and thereby achieves faster force decay rate. Still further, burn depth is minimized by properly controlling reduction in the grinding force near the end of the grinding cycle.

As also shown in FIG. 3, a single or multiple accelerometers 245 can be placed on the grinding machine for vibration detection. This information can then be used to actively compensate the signal from the load transducer to remove portions of the signal associated with these unrelated vibrations so that a more accurate normal grind force data can be calculated.

Still further, the normal force data can be used to control the feed rate to achieve constant force grinding. In the past, constant force grinding has been regulated by detecting spindle deflection or with transducers mounted under the wheelhead. In contrast, the present invention provides a direct measurement of the grinding force while insulating the load transducer from the grinding environment.

In particular embodiments, the load washer transducer assembly can be incorporated in both slide mechanisms. This configuration is particularly helpful to compensate for the grinding of compound or slanted surfaces, since in these applications, the normal force is controlled by the operation of both the feed and Z-slides. As a still further change, instead of the ball screw configuration, a hydrostatic or acme-type screws can be used.

Figure 4:
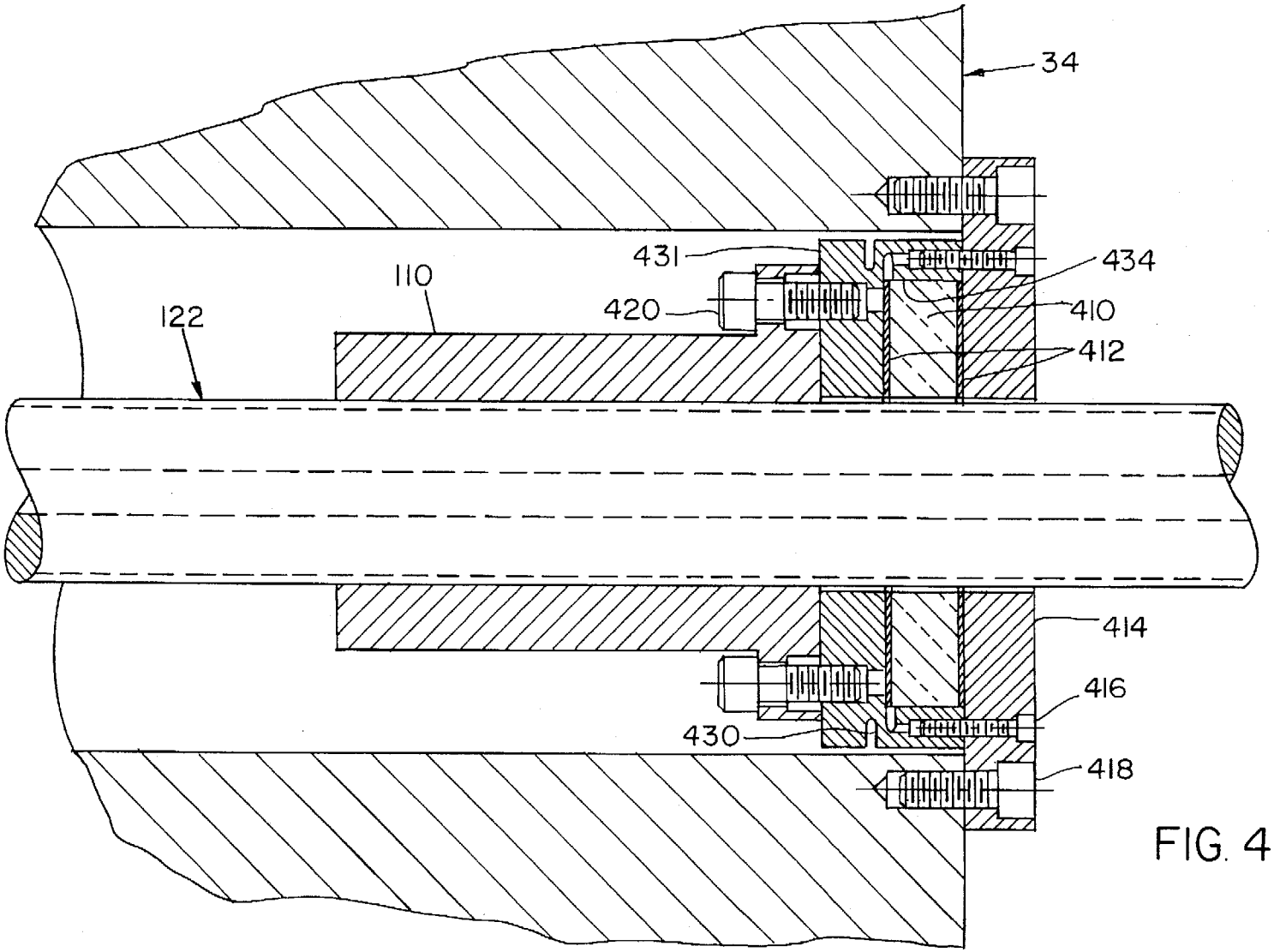
FIG. 4 is a partial cross-sectional view of a ball nut mounted transducer of a preferred embodiment of the present invention.
Figure 5:
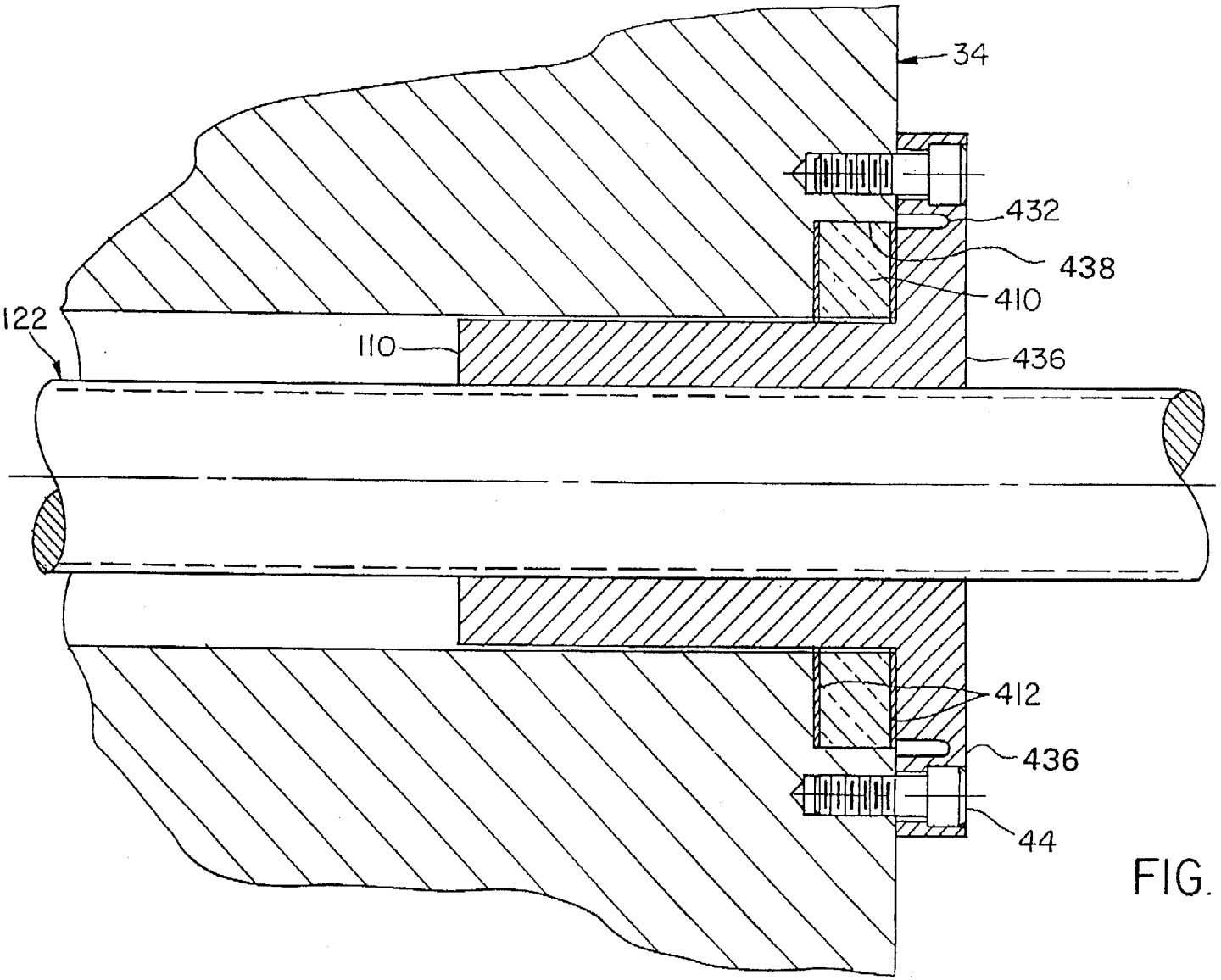
FIG. 5 is a partial cross-sectional view of another preferred embodiment of a ball nut mounted transducer.

Referring to FIGS. 4 and 5, two alternative implementations of a second embodiment of the present invention are illustrated. Here, generally, a load washer 410 has been incorporated into a different portion of the coupling mechanism 100, namely the junction between the slide 34 and the ball nut 110. This new load washer 410 can be added either in addition to or instead of load washer 182 in the ball screw housing 130. Specifically, as illustrated in FIG. 4, the ball nut 110 is bolted to a load cell cup 431 by bolts 420. A rigid mounting plate 414 is in turn bolted to both the load cell cup 431 and the slide 34 by bolts 416 and 418, respectively. An annular space defined by the inner surfaces of the load cell cup 431 and the rigid mounting plate 414 holds the load washer 410. This load washer 410 is electrically insulated from the load cell cup 431 and mounting plate 414 by optional insulating washers 412. The load cell cup 431 has two or more annular reliefs 430 so that the longitudinal portion 434 of the load cell cup forms a semi-rigid flexure.

The depth of the load cell cup, i.e. internal length of the longitudinal portion 434 is sized to be slightly less deep than the thickness of the load washer 410, plus the thicknesses of the insulating washers 412. As a result, by tightening bolts 416, the load washer 410 can be preloaded by the lengthwise flexing of the load cell cup rim 434 enabled by the reliefs 430. As a result, forces between the slide carriage 34 and the ball nut 110 can be sensed by the load cell 410. This implementation has certain advantages arising out of the fact that a standard catalog ball nut 110 and load washer 410 can be used.

Referring to the second implementation illustrated in FIG. 5, a modified ball nut 110 has a relatively larger lip portion 436 in which an annular relief 432 has been formed so that the outer portion of this lip 436 forms a semi-rigid flexure. The lip 436 is bolted to the slide carriage 34 by bolt 44.

An annular portion 438 of the slide 34 has been removed to accommodate the load washer 410 and optional insulating washers 412, electrically isolating the load washer 410. The depth of this annular cut out portion 438 is sized to be slightly less deep than the thickness of the load washer 410 and the insulating washers 412. As a result, the load washer 410 can be preloaded by tightening bolts 44 to sense the forces exerted between the slide 34 and the ball nut 110. Optionally, shims (not shown) may be used behind the load cell or the flange of the ball nut to set the preload offset. This second implementation has a somewhat simpler design but includes a non-standard ball nut 110 and requires modifications to the slide 34.

Equivalents

Those skilled in the art will recognize, or be able to ascertain using no more than routine experimentation, many equivalents to specific embodiments of the invention described specifically herein. Such equivalents are intended to be encompassed in the scope of the following claims.

We claim:

1. A computer controlled grinding machine having a slide force transducer, the machine comprising:

a grinding machine base;

a slide that moves along a slide axis relative to the machine base to position a grinding tool relative to a workpiece;

a drive mechanism that moves the slide relative to the machine base along the slide axis;

a drive screw assembly that connects the drive mechanism to the slide;

a force transducer mounted on the drive screw assembly to measure a force exerted by the slide on the drive screw assembly during a grinding operation; and a control system that controls the machine in response to the force detected by the force transducer.

2. The computer controlled grinding machine of claim 1 wherein the drive screw assembly comprises a ball screw, a ball nut and a ball screw housing.

3. A computer controlled grinding machine having a slide force transducer, the machine comprising:

a grinding machine base;

a slide that moves along a slide axis relative to the machine base to position a grinding tool relative to a workpiece;

a drive mechanism that moves the slide relative to the machine base along the slide axis;

a drive screw assembly that connects the drive mechanism to the slide and that includes a lead screw, a nut and a screw housing;

a force transducer that is positioned in a mechanical junction between the nut and the slide to measure a force exerted by the slide on the drive screw assembly during a grinding operation; and a control system that controls the machine in response to the force detected by the force transducer.

4. A computer controlled grinding machine having a slide force transducer, the machine comprising:

a grinding machine base;

a slide that moves along a slide axis relative to the machine base to position a grinding tool relative to a workpiece;

a drive mechanism that moves the slide relative to the machine base along the slide axis;

a drive screw assembly that connects the drive mechanism to the slide and that includes a lead screw, a nut and a screw housing;

a force transducer that is mounted in the screw housing to measure a force exerted by the slide on the drive screw assembly during a grinding operation; and a control system that controls the machine in response to the force detected by the force transducer.

5. The computer controlled grinding machine of claim 1 wherein the force transducer comprises a piezoelectric load washer transducer or strain gage transducer.

6. A computer controlled grinding machine having a slide force transducer, the machine comprising:

a grinding machine base;

a slide that moves along a slide axis relative to the machine base to position a grinding tool relative to a workpiece;

a drive mechanism that moves the slide relative to the machine base along the slide axis;

a drive screw assembly that connects the drive mechanism to the slide;

a force transducer that generates a signal indicative of a grinding force between a workpiece and a grinding wheel during a grinding operation;

at least one accelerometer that detects vibration of the grinding machine; and a control system that controls the machine in response to the force signal detected by the force transducer and compensated by the at least one accelerometer to remove contributions to force signal that are unrelated to the grinding force.

7. The computer controlled grinding machine of claim 1 wherein the control system comprises a charge amplifier, a signal conditioning circuit, a digital signal processor and a machine controller.

8. The computer controlled grinding machine of claim 1 further comprising one or more accelerometer(s) to measure vibration of the grinding machine and to compensate a force transducer signal generated by the force transducer.

9. The computer controlled grinding machine of claim 1 further comprising a wheelhead and a workhead, one of which being mounted on the slide.

10. A method of controlling a grinding operation comprising:

providing a grinding machine having a machine base, a slide mounted on the base and moving along a slide axis relative to the base, a drive mechanism to actuate movement of the slide, a drive screw assembly connecting the drive mechanism to the slide, and a force transducer mounted to the drive screw assembly;

grinding a workpiece with a grinding wheel only one of which is mounted on the slide;

measuring a force between the grinding wheel and the workpiece with the force transducer; and controlling a grinding machine operation in response to a signal generated by the force transducer.

11. The method of claim 10 further comprising providing a drive screw assembly having a lead screw which rotates to move the slide along the slide axis, a nut, and a screw housing that secures one end of the lead screw to the machine base.

12. The method of claim 11 further comprising positioning the force transducer in a mechanical junction between the nut and the slide.

13. The method of claim 11 further comprising providing the force transducer mounted within the screw housing.

14. The method of claim 10 further comprising controlling a feed rate of the grinding wheel relative to the workpiece in response to a signal generated by the force transducer.

15. The method of claim 10 further comprising providing a charge amplifier, a signal conditioning circuit, a digital signal processor and a machine controller, the processor receiving an amplified and conditioned signal from the force transducer and generating an instruction signal delivered to the machine controller.

16. A method of controlling a grinding operation comprising:

providing a grinding machine having a machine base, a slide mounted on the base and moving along a slide axis relative to the base, a drive mechanism to actuate movement of the slide, a drive screw assembly connecting the drive mechanism to the slide, and a force transducer mounted to the drive screw assembly;

grinding a workpiece with a grinding wheel only one of which is mounted on the slide;

measuring a force between the grinding wheel and the workpiece with the force transducer; and controlling a grinding machine operation in response to a signal generated by the force transducer by adjusting a feedrate and feed position to track a reference force versus time profile.

17. The method of claim 16 further comprising performing a spark out interval in which the grinding wheel is withdrawn from the workpart to increase a force decay rate, the interval including a rapid reduction in a grinding force from a rough force level to a finish force level.

18. The method of claim 17 further comprising performing proportional and integral error control of the force between the grinding wheel and the workpiece.

19. The method of claim 10 further comprising:

providing one or more accelerometer(s) to measure a vibration of the grinding machine, the accelerometer generating a vibration compensation signal; and compensating the force transducer signal with the vibration compensation signal.

20. A computer controlled grinding machine having a slide force transducer comprising:

a grinding machine base;

a first slide that moves along a first slide axis relative to the machine base;

a first drive mechanism that moves the first slide relative to the machine base along the first slide axis;

a second slide that moves along a second slide axis relative to the machine base;

a first coupler that connects the first drive mechanism to the first slide;

a first force transducer mounted on the first coupler to measure a force exerted by the first slide during a grinding operation; and a control system connected to the first force transducer and the first drive mechanism, the control system having a programmable data processor.

21. The computer controlled grinding machine of claim 20 wherein the first coupler comprises a lead screw, a nut and a screw housing.

22. The computer controlled grinding machine of claim 21 wherein the force transducer is positioned in the screw housing.

23. The computer controlled grinding machine of claim 20 wherein the force transducer comprises a load washer transducer or strain gage transducer.

24. The computer controlled grinding machine of claim 20 wherein the control system comprises a charge amplifier, a signal conditioning circuit, a digital signal processor and a machine controller.

25. The computer controlled grinding machine of claim 20 further comprising one or more accelerometer(s) to measure vibration of the grinding machine and to compensate a force transducer signal generated by the first force transducer.

26. The computer controlled grinding machine of claim 21 wherein the first force transducer is positioned in a mechanical junction between the nut and the first slide.

27. The computer controlled grinding machine of claim 20, further comprising:

a second drive mechanism that moves the second slide relative to the machine along the second slide axis;

a second coupler that connects the second drive mechanism to the second slide; and a second force transducer mounted to the second coupler to measure a force exerted by the second slide.

28. The computer controlled grinding machine of claim 27 wherein the first and second slides form a compound slide.

29. The computer controlled grinding machine of claim 27 further comprising a wheelhead and a workhead mounted on the first and second slides.

30. The computer controlled grinding machine of claim 29 wherein the first slide is a feed slide and supports the workhead and the second slide is a Z-slide and supports the wheelhead, or alternatively, the workhead is mounted on a Z-slide with the wheelhead on the feed slide.

31. A computer controlled grinding machine having a slide force transducer, the machine comprising:

a grinding machine base;

a slide that moves along a slide axis relative to the machine base to position a grinding tool relative to a workpiece;

a drive mechanism that moves the slide relative to the machine base along the slide axis;

a drive screw assembly that connects the drive mechanism to the slide;

a force transducer mounted on the drive screw assembly to measure a force exerted by the slide on the drive screw assembly during a grinding operation; and a control system that adjusts a feedrate and feed position to track a reference force versus time profile in response to the force detected by the force transducer.

32. A computer controlled grinding machine having a slide force transducer, the machine comprising:

a grinding machine base;

a slide that moves along a slide axis relative to the machine base to position a grinding tool relative to a workpiece;

a drive mechanism that moves the slide relative to the machine base along the slide axis;

a drive screw assembly that connects the drive mechanism to the slide;

a force transducer mounted on the drive screw assembly to measure a force exerted by the slide on the drive screw assembly during a grinding operation; and a control system that controls a feedrate of the grinding tool relative to a workpiece to increase a force decay rate during a spark out interval in which a grinding wheel is withdrawn from the workpiece in response to the force detected by the force transducer.

33. The computer controlled grinding machine of claim 32 wherein the control system performs proportional and integral error control of the force between the grinding wheel and the workpiece.

34. A computer controlled grinding machine having a slide force transducer, the machine comprising:

a grinding machine base;

a slide that moves along a slide axis relative to the machine base to position a grinding tool relative to a workpiece;

a drive mechanism that moves the slide relative to the machine base along the slide axis;

a drive screw assembly that connects the drive mechanism to the slide;

a force transducer mounted on the drive screw assembly to measure a force exerted by the slide on the drive screw assembly during a grinding operation: and a control system that controls the feedrate to provide a rapid reduction in a grinding force from a rough force level to a finish force level in response to the force detected by the force transducer.

35. The computer controlled grinding machine of claim 1 wherein the force transducer is preloaded with a compressive load.

36. The computer controlled grinding machine of claim 35, further comprising a semi-rigid member that places the force transducer under a compressive load.

37. The computer controlled grinding machine of claim 4, further comprising:

a load washer nut that is rigidly connected to the screw housing; and a semi-rigid member, the force transducer being compressively loaded by the semi-rigid member against the load washer nut.

38. The computer controlled grinding machine of claim 3 further comprising a semirigid member for compressively loading the force transducer against the slide.

39. The computer controlled grinding machine of claim 8 further comprising a low pass filter that filters the response of the accelerometer(s).

40. The computer controlled grinding machine of claim 28 wherein the compound slide supports either a wheelhead or a workhead and the other head is stationary with respect to the grinding machine base.

41. The computer controlled grinding machine of claim 6 wherein the drive screw assembly comprises a lead screw, a nut and a screw housing.

42. The computer controlled grinding machine of claim 41 wherein the force transducer is positioned in a mechanical junction between the nut and the slide.

43. The computer controlled grinding machine of claim 41 wherein the force transducer mounted in the screw housing.

44. The computer controlled grinding machine of claim 6 wherein the force transducer comprises a piezoelectric load washer transducer or strain gage transducer.

* * * * *